US008683747B2

(12) United States Patent
Kim

(10) Patent No.: US 8,683,747 B2
(45) Date of Patent: Apr. 1, 2014

(54) MODULAR WINDOW APPARATUS WITH LIQUID DRAINAGE ABILITY

(76) Inventor: Soon Seok Kim, Paju-si (KR)

( * ) Notice: Subject to any disclaimer, the term of this patent is extended or adjusted under 35 U.S.C. 154(b) by 229 days.

(21) Appl. No.: 13/254,265

(22) PCT Filed: Jan. 18, 2010

(86) PCT No.: PCT/KR2010/000305

§ 371 (c)(1),
(2), (4) Date: Sep. 1, 2011

(87) PCT Pub. No.: WO2010/101351

PCT Pub. Date: Sep. 10, 2010

(65) Prior Publication Data

US 2012/0005975 A1 Jan. 12, 2012

(30) Foreign Application Priority Data

Mar. 2, 2009 (KR) ..... 10-2009-0017753

(51) Int. Cl.
*E06B 1/70* (2006.01)

(52) U.S. Cl.
USPC ..... 49/471; 49/467; 49/408; 49/404; 49/411; 49/425; 52/209

(58) Field of Classification Search
USPC ..... 49/467–471, 408, 404, 410, 411, 425; 16/96 R, 94 R; 52/209, 204.51, 207
See application file for complete search history.

(56) References Cited

U.S. PATENT DOCUMENTS 2,787,034 A * 4/1957 Hauck ..... 52/209
3,503,169 A * 3/1970 Maki et al. ..... 52/209
3,859,754 A * 1/1975 Budich et al. ..... 49/425
3,975,881 A * 8/1976 Ninowski, Jr. ..... 52/775
4,310,991 A * 1/1982 Seely ..... 49/470
4,691,487 A * 9/1987 Kessler ..... 52/209

(Continued)

FOREIGN PATENT DOCUMENTS

KR 10-167124 B1 9/1998
KR 20-0242636 Y1 10/2001

(Continued)

OTHER PUBLICATIONS

International Search Report, Appln No. PCT/KR2010/000305, dated Aug. 24, 2010.

*Primary Examiner* — Katherine Mitchell
*Assistant Examiner* — Marcus Menezes
(74) *Attorney, Agent, or Firm* — Kile Park Reed & Houtteman PLLC

(57) ABSTRACT

Disclosed is an easy-to-construct window apparatus including to assure easy construction and superior drainage ability. The window apparatus includes a window frame fixing unit including a bottom plate, vertical plates formed at lateral ends of the bottom plate and a rack plate formed at each vertical plate, a window frame support unit including a seat plate on the rack plate, a support plate configured to be supported on the bottom plate, fastening pieces protruding from the seat plate, and a holding groove formed in each fastening piece, a rail unit including a horizontal plate provided with a rail and a coupling piece, and a holding ridge formed at the coupling piece so as to be coupled with the holding groove, a window drive unit including a press-fit structure to be press-fitted into a window, and water discharge holes perforated in the aforementioned units.

5 Claims, 13 Drawing Sheets

(56) References Cited

U.S. PATENT DOCUMENTS

| | | | | |
|---|---|---|---|---|
| 5,103,589 | A * | 4/1992 | Crawford | 49/125 |
| 5,123,212 | A * | 6/1992 | Dallaire et al. | 52/209 |
| 5,283,977 | A * | 2/1994 | Smith | 49/380 |
| 5,836,111 | A * | 11/1998 | Tak | 49/425 |
| 7,637,058 | B2 * | 12/2009 | Lai | 49/425 |
| 2003/0177699 | A1 * | 9/2003 | Fukuro et al. | 49/408 |

FOREIGN PATENT DOCUMENTS

| | | | |
|---|---|---|---|
| KR | 10-439112 | B1 | 7/2004 |
| KR | 20-0375065 | Y1 | 2/2005 |
| KR | 20-0435826 | Y1 | 2/2007 |
| KR | 10-0791030 | B1 | 1/2008 |

* cited by examiner

MODULAR WINDOW APPARATUS WITH LIQUID DRAINAGE ABILITY

TECHNICAL FIELD

The present invention relates to an easy-to-construct window apparatus, and more particularly, to an easy-to-construct window apparatus in which a window, such as a balcony window or an entrance/exit window, and a frame, to which the window is coupled in a sliding opening/closing manner, have an improved configuration to assure an easy construction and superior drainage ability.

BACKGROUND ART

In general, a window apparatus for use in a variety of buildings is essentially comprised of a window, such as a balcony window or an entrance/exit window, and a frame to which the window is coupled in a sliding opening/closing manner. Such a window apparatus must fulfill requirements of high grade mechanical properties required to overcome the weight of glass and to achieve durability and weather ability against outside air.

Recently, various shapes of windows, such as e.g., system windows and anti-crime windows, have been developed and used. One example of the system windows is a vertical sliding type system window, which provides a building with upgraded appearance and functionality and is widely applied to relatively large scale windows, such as e.g., living room windows and balcony windows.

In a conventional window apparatus, a frame is provided with a rail groove, to which a window, such as a balcony window or an entrance/exit window, is coupled in a sliding opening/closing manner. The rail groove, however, may disadvantageously act as an obstacle that makes passage of person's feet uncomfortable or may cause persons' feet to be dangerously caught thereby. Moreover, in the case where the frame is installed at a balcony, impurities, such as dust, etc., may be easily accumulated in the rail groove and a cleaning operation to remove the impurities from the rail groove may be difficult. In particular, the frame installed at the balcony and the rail groove thereof are easily exposed to invasion of wind and rainwater, suffering from considerable deterioration in air tightness and drainage ability.

To solve the above described disadvantages, Korean Registered Patents No. 10-167124 and No. 10-439112 disclose rail concealed type window apparatuses having enhanced air tightness and drainage ability. However, the disclosed configurations have several problems in that complexity in the configuration of coupling a window, such as a balcony window or an entrance/exit window, to a rail groove of a frame makes it very difficult to separate the window from the rail groove, in that a rainwater drain means is not provided, which results in poor drainage ability, and in that a simple windshield structure is not sufficient to tightly intercept invasion of wind.

DISCLOSURE

Technical Problem

Therefore, the present invention has been made in view of the above problems of the prior art, and it is an object of the present invention to provide an easy-to-construct window apparatus wherein a window, such as a balcony window or an entrance/exit window, and a frame, to which the window is coupled in a sliding opening/closing manner, have a simplified easy-to-construct configuration, which enables easy attachment or detachment of the window to or from the frame, and wherein an improved multi stage shield configuration in relation to airtightness is provided to ensure easy interception of wind and noise and improve drainage ability of water, such as rainwater.

Technical Solution

In accordance with an aspect of the present invention, the above and other objects can be accomplished by the provision of an easy-to-construct window apparatus including at least one window frame fixing unit of a top open type, which is fixedly mounted on a window frame installation plane in two or more rows, wherein the window frame fixing unit includes a bottom plate, vertical plates integrally formed at opposite lateral ends of the bottom plate, and a rack plate integrally formed at a middle height position of an inner surface of each vertical plate, a window frame support unit including a seat plate, either lateral end of which is seated on the rack plate of the window frame fixing unit, a support plate integrally protruding downward from a lower surface of the seat plate so as to be supported on the bottom plate of the window frame fixing unit, a pair of fastening pieces integrally protruding upward from an upper surface of the seat plate, and a holding groove formed in an inner wall surface of each fastening piece, a rail unit including a horizontal plate, a rail integrally protruding upward from an upper surface of the horizontal plate, a coupling piece protruding downward from a lower surface of the horizontal plate, and a holding ridge integrally formed at an outer wall surface of the coupling piece so as to be coupled with the holding groove in a one touch manner, a window drive unit including a press-fit structure configured to be press-fitted into a press-fit room defined in a lower region of a window, the press-fit structure including a top plate and lateral plates integrated with each other, a roller coupled to a lower surface of the top plate of the press-fit structure in a rolling movable manner, and an L-shaped pedestal plate provided at a lower end of each lateral plate of the press-fit structure so as to support the window while being inserted into a space between the vertical plate of the window frame fixing unit and the horizontal plate of the rail unit, and a plurality of water discharge holes perforated in the window frame fixing unit, the window frame support unit, the rail unit and the window drive unit so as to communicate with the outside respectively.

The at least one window frame fixing unit, which is mounted on the window frame installation plane in two or more rows, may include an inner window frame fixing unit and an outer window frame fixing unit, and an outer vertical plate of the inner window frame fixing unit and an inner vertical plate of the outer window frame fixing unit may be respectively provided with first and second coupling grooves, and a connection strip having a hermetic function is inserted into the first and second coupling grooves, so as to realize a hermetic coupling between the inner window frame fixing unit and the outer window frame fixing unit.

The plurality of water discharge holes may include a first water discharge hole vertically perforated through the horizontal plate of the rail unit, a plurality of second water discharge holes vertically perforated through the seat plate of the window frame support unit, a plurality of third water discharge holes vertically perforated through the support plate of the window frame support unit, fourth water discharge holes horizontally perforated respectively at lower end positions of the outer vertical plate of the inner window frame fixing unit and the inner vertical plate of the outer window frame fixing unit, and a final drain hole horizontally perforated at a lower end position of an outer vertical plate of the outer window frame fixing unit.

Vertically incised fitting slots may be longitudinally arranged at an upper surface of the press-fit structure of the window drive unit, and a fixing bracket may be integrally screwed to a ceiling surface of the press-fit room of the window and may be provided with a downwardly protruding insert so as to be inserted into a corresponding one of the fitting slots.

The easy-to-construct window apparatus may further include upper and lateral window frame fixing units integrally connected to the window frame fixing unit so as to be located at upper and lateral sides of the window frame fixing unit, the upper or lateral window frame fixing unit including a double layered bottom plate and a pair of fastening pieces integrally formed at the center of an upper surface of the double layered bottom plate, each fastening piece having a holding groove, a finishing plate including a flat plate, and a pair of coupling pieces integrally formed at a lower surface of the flat plate, each coupling piece having a holding ridge configured to be coupled with the holding groove of a corresponding one of the pair of fastening pieces in a one touch manner, upper and lateral window finishing structures configured to be press-fitted into press-fit rooms defined respectively in upper and lateral regions of the window, each window finishing structure including a top plate, lateral plates and L-shaped pedestal plates at lower ends of the lateral plates, and a shock-absorbing stopper situated outside each fastening piece of the lateral window frame fixing unit and integrally attached to the upper surface of the bottom plate.

Advantageous Effects

With the above described technical solutions, the present invention provides the following effects.

According to the present invention, easy separation and assembly of a variety of windows, such as a balcony window or an entrance/exit window, are accomplished, which advantageously results in a convenient removal operation for replacement and repair purposes.

In particular, as a result of providing an improved multi stage shield configuration in relation to airtightness, it is possible to completely intercept invasion of wind, nose and impurities, and the like. Moreover, an improved water drainage configuration capable of guiding flow of water to the outside ensures easy discharge of impurities, such as beverages, or rainwater, which results in a remarkable increase in drainage ability.

In addition, it is possible to prevent impurities from becoming jammed in a frame, which can allow an easy cleaning operation and assist in keeping the frame clean.

DESCRIPTION OF DRAWINGS

The above and other objects, features and other advantages of the present invention will be more clearly understood from the following detailed description taken in conjunction with the accompanying drawings, in which.

BEST MODE

Hereinafter, preferred embodiments of the present invention will be described in detail with reference to the accompanying drawings.

Figure 1:
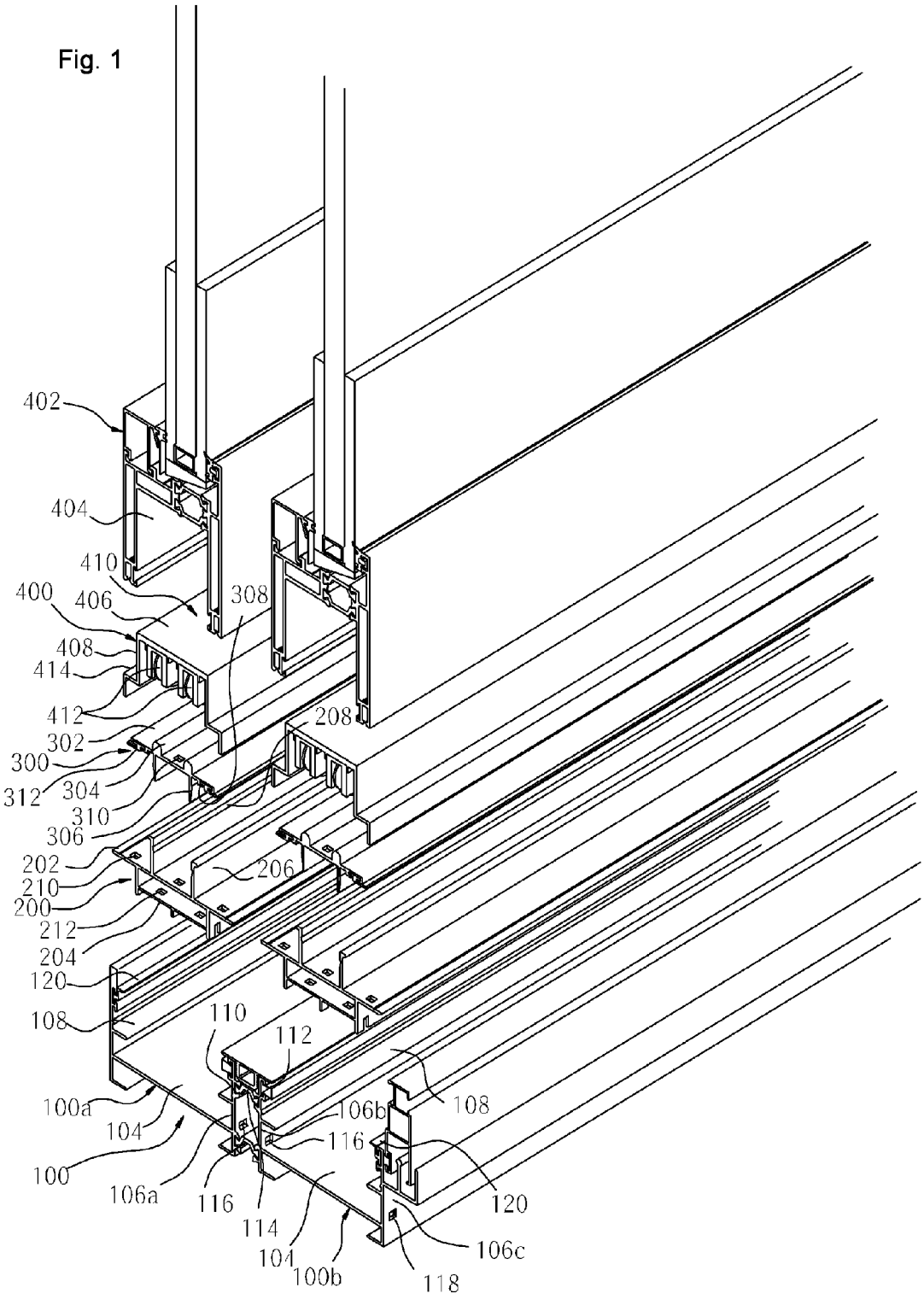
FIG. 1 is an exploded perspective view illustrating an easy-to-construct window apparatus in accordance with the present invention.
Figure 2:
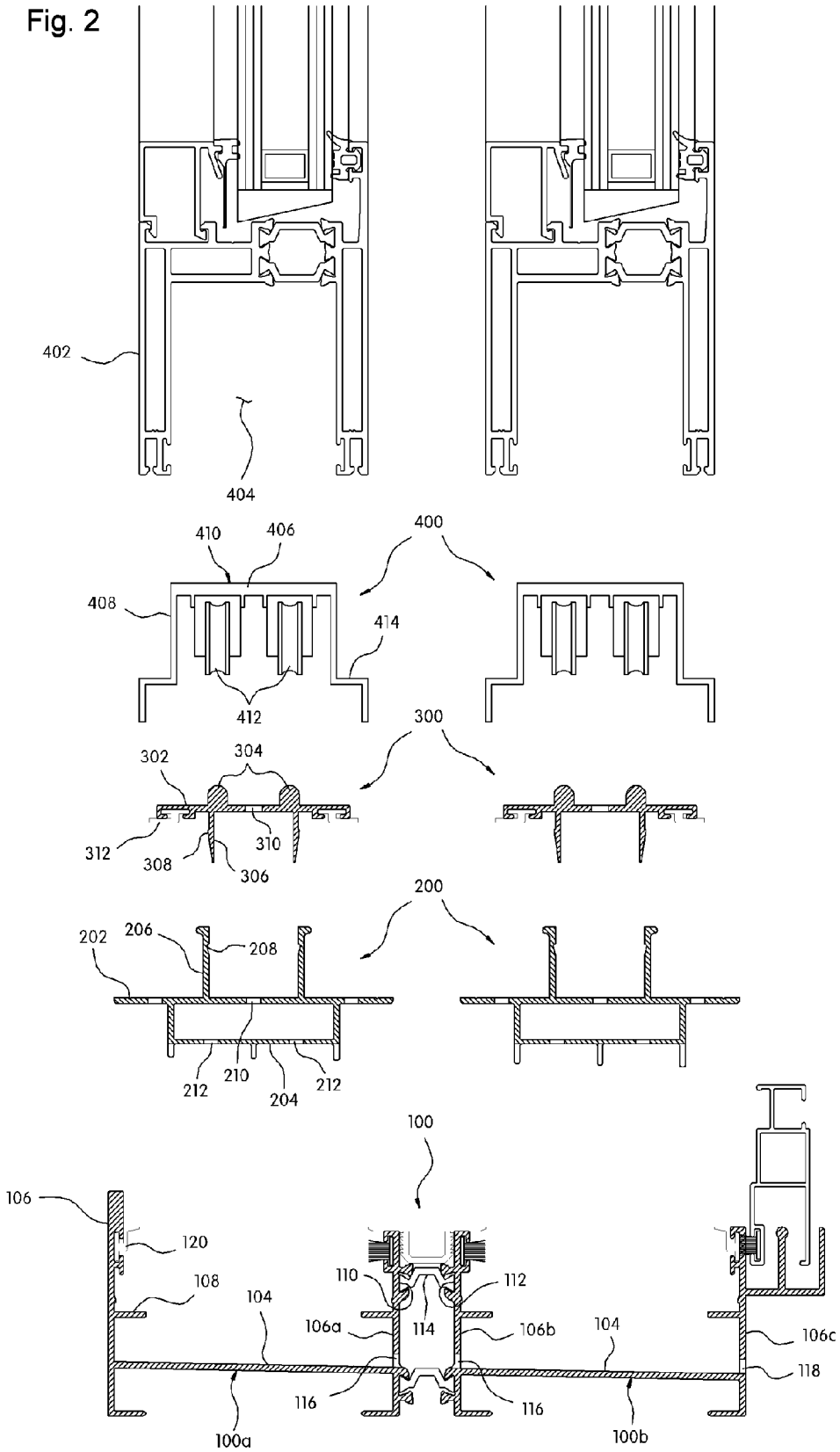
FIG. 2 is an exploded sectional view illustrating the easy-to-construct window apparatus in accordance with the present invention.
Figure 3:
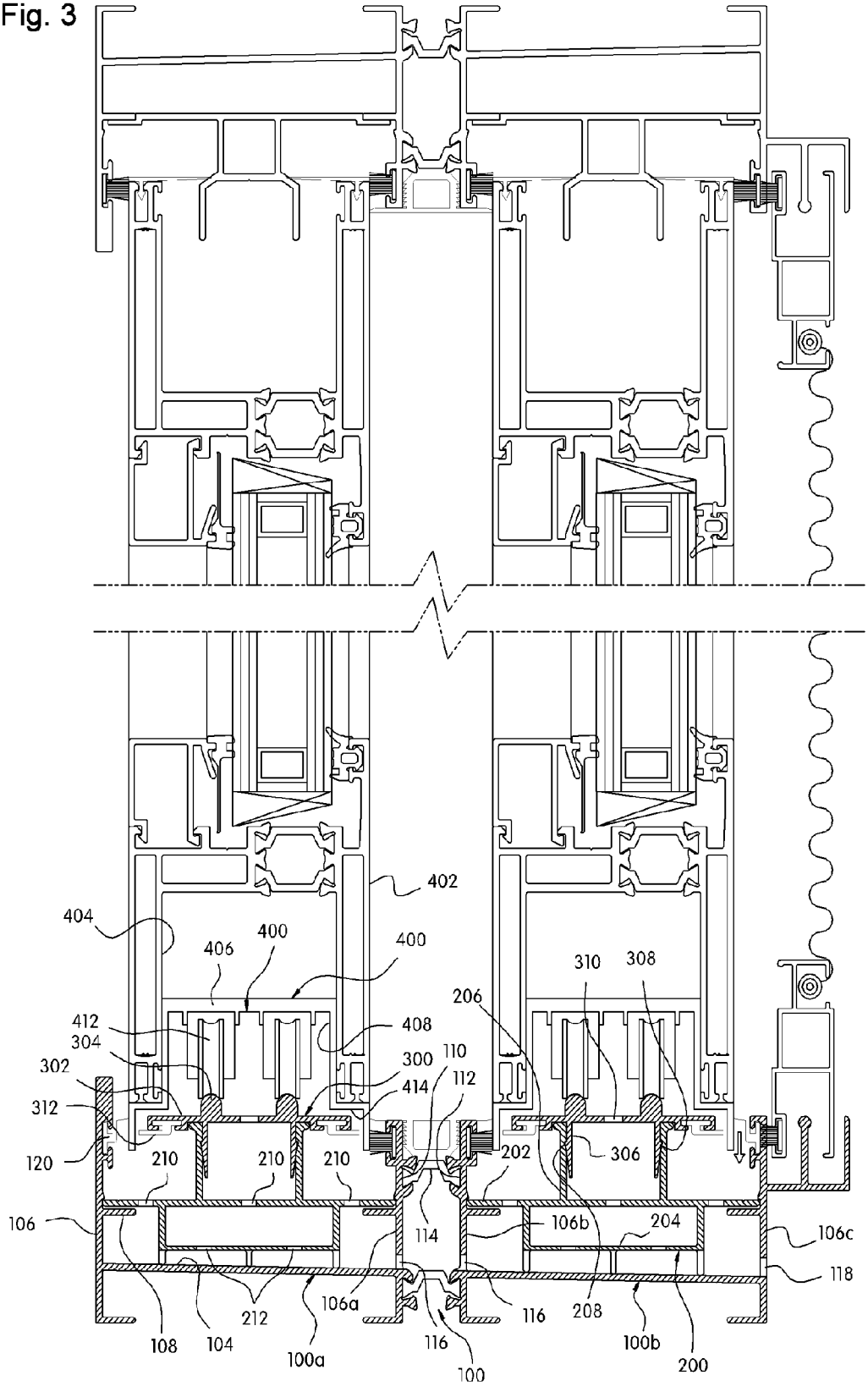
FIG. 3 is an assembled sectional view illustrating the easy-to-construct window apparatus in accordance with the present invention.
Figure 4:
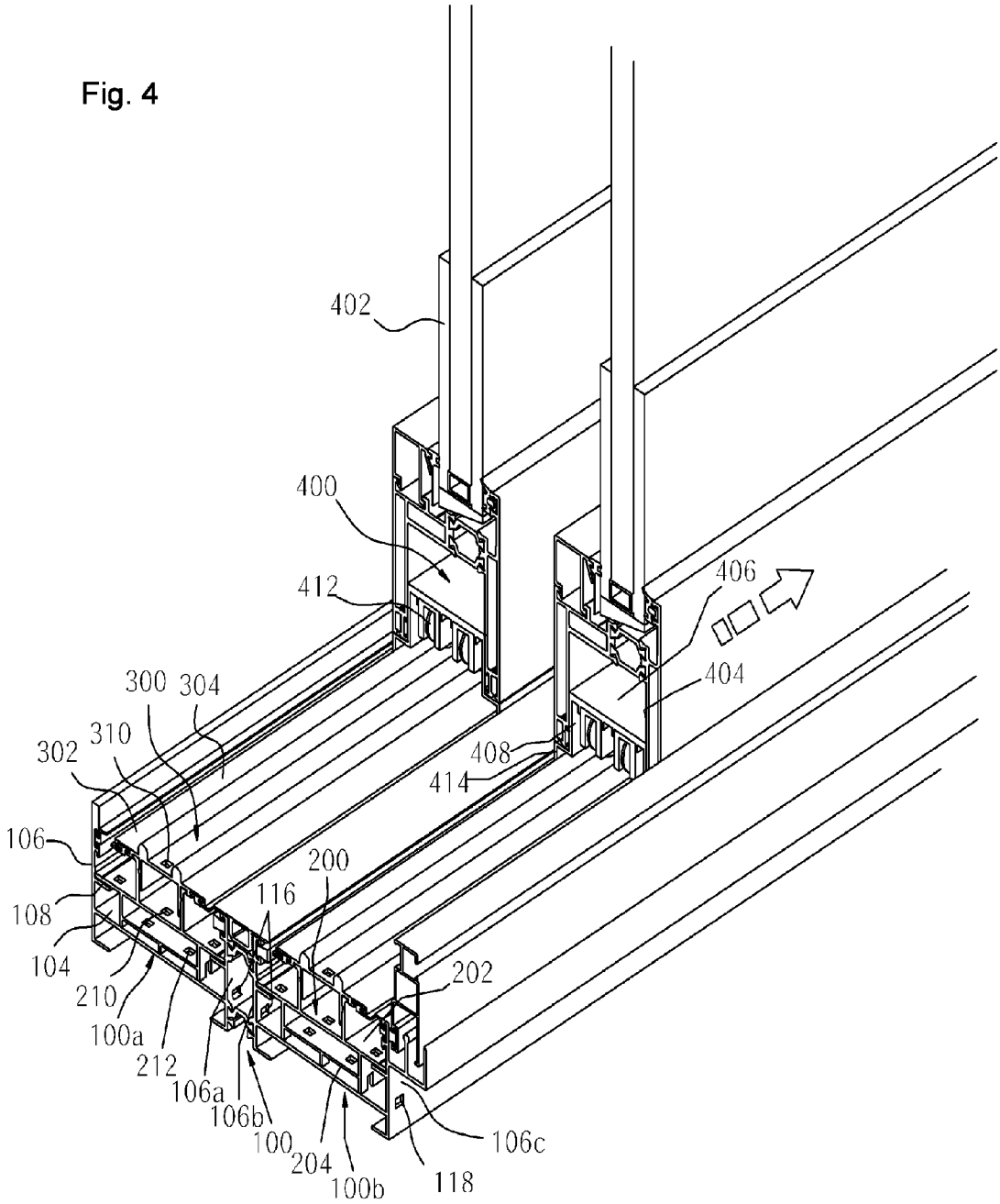
FIG. 4 is a perspective view illustrating an opening/closing operation of the easy-to-construct window apparatus in accordance with the present invention.

FIG. 1 is an exploded perspective view illustrating an easy-to-construct window apparatus in accordance with the present invention, FIG. 2 is an exploded sectional view illustrating the easy-to-construct window apparatus in accordance with the present invention, and FIG. 3 is an assembled sectional view illustrating the easy-to-construct window apparatus in accordance with the present invention.

The easy-to-construct window apparatus in accordance with the present invention exhibits easy separation and assembly thereof and therefore, achieves several advantages including a convenient removal operation for replacement and repair purposes, excellent wind and/or noise shield effects, and superior drainage ability owing to outward guidance of water. To this end, the window apparatus in accordance with the present invention generally includes a window frame fixing unit 100 fixedly mounted on a window frame installation plane 102 in two or more rows, a window frame support unit 200 seated on and fastened to the window frame fixing unit 100 so as to cover a top opening of the window frame fixing unit 100, a rail unit 300 coupled to the window frame support unit 200 in a one touch manner so as to enable sliding opening/closing operations of a window 402, and a window drive unit 400 coupled to a lower end of the window 402 while being slidably coupled to the rail unit 300 so as to provide the window 402 with substantial opening/closing drive force.

The window frame fixing unit 100 is a chassis structure of a top open type, which is arranged and fixedly mounted in two or more rows on the window frame installation plane 102, such as a concrete ground for installation of e.g., a balcony window. The window frame fixing unit 100 includes a bottom plate 104 in the form of a horizontal plate fixedly mounted on the window frame installation plane 102, and a pair of vertical plates 106 integrated with the bottom plate 104 so as to extend upward from opposite lateral ends of the bottom plate 104. In particular, a rack plate 108 integrally protrudes from a middle height position of an inner surface of each vertical plate 106.

In an embodiment in which a plurality of window frame fixing units 100 is arranged in two or more rows on the window frame installation plane 102, the plurality of window frame fixing units 100 may include an inner window frame fixing unit 100*a* facing the indoors and an outer window frame fixing unit 100*b* facing the outdoors. The inner window frame fixing unit 100*a* and the outer window frame fixing unit 100*b* are connected to each other in such a manner that a hermetically sealed gap is defined therebetween.

More particularly, an outer vertical plate 106*a* of the inner window frame fixing unit 100*a* and an inner vertical plate 106*b* of the outer window frame fixing unit 100*b* are respectively provided with first and second coupling grooves 110 and 112, and a connection strip 114 having a hermetic function is inserted into the first and second coupling grooves 110 and 112, so as to realize a hermetic coupling between the inner window frame fixing unit 100*a* and the outer window frame fixing unit 100*b*. A finishing plate in the form of a flat plate is provided on the connection strip 114 so as to cover the connection strip 114.

The window frame support unit 200 is seated on the window frame fixing unit 100 having the above described configuration so as to cover the top opening of the window frame fixing unit 100.

The window frame support unit 200 includes a seat plate 202 in the form of a horizontal plate, a support plate 204 integrally protruding downward from a lower surface of the seat plate 202 so as to be supported on the bottom plate 104 of the window frame fixing unit 100, and a pair of fastening pieces 206 integrally protruding upward from an upper surface of the seat plate 202 to realize one touch coupling with the rail unit 300.

With the above described configuration, as opposite lateral ends of the lower surface of the seat plate 202 of the window frame support unit 200 are seated on the rack plates 108 of the window frame fixing unit 100 and a lower end of the support plate 204 of the window frame support unit 200 comes into close contact with and is supported on the bottom plate 104 of the window frame fixing unit 100, seating and coupling of the window frame support unit 200 with respect to the window frame fixing unit 100 are accomplished.

Additionally, each fastening piece 206 of the window frame support unit 200 is provided at an inner wall surface thereof with a holding groove 208.

The rail unit 300 is coupled onto the window frame fixing unit 200 in a one touch manner.

The rail unit 300 includes a horizontal plate 302, a pair of rails 304 protruding upward from an upper surface of the horizontal plate 302, a pair of coupling pieces 306 protruding downward from a lower surface of the horizontal plate 302, and holding ridges 308 integrally formed at outer surfaces of the respective coupling pieces 306.

With the above described configuration, when the coupling pieces 306 of the rail unit 300 are inserted and pushed into the window frame support unit 200, the holding ridges 308 of the coupling pieces 306 are coupled to the holding grooves 208 of the fastening pieces 206 in a one touch manner, the rail unit 300 is completely assembled with the window frame support unit 200.

In the present embodiment, the window drive unit 400 is seated on the rails 304 of the rail unit 300 and is linearly movable in sliding manner. The window drive unit 400 is press-fitted into the lower end of the window 402 so as to be assembled with the window 402.

Specifically, the window drive unit 400 includes a press-fit structure 410 which in turn includes a top plate 406 in the form of a horizontal plate and lateral plates 408 integrated with the top plate 406 so as to extend downward from opposite lateral ends of the top plate 406. As the press-fit structure 410 is press-fitted into a press-fit room 404 defined in a lower region of the window 402, assembly between the window drive unit 400 and the window 402 is accomplished. In addition, a pair of rollers 412 is attached to a lower surface of the top plate 406 of the press-fit structure 410 and is seated on the rails 304 of the rail unit 300 in a rolling movable manner.

In the present embodiment, both the lateral plates 408 of the press-fit structure 410 are respectively integrally provided at lower ends thereof with pedestal plates 414. The pedestal plates 414 serve to support the window 402 and are respectively positioned so as to be inserted into spaces between both the vertical plates 106 of the window frame fixing unit 100 and the horizontal plate 302 of the rail unit 300.

Figure 6:
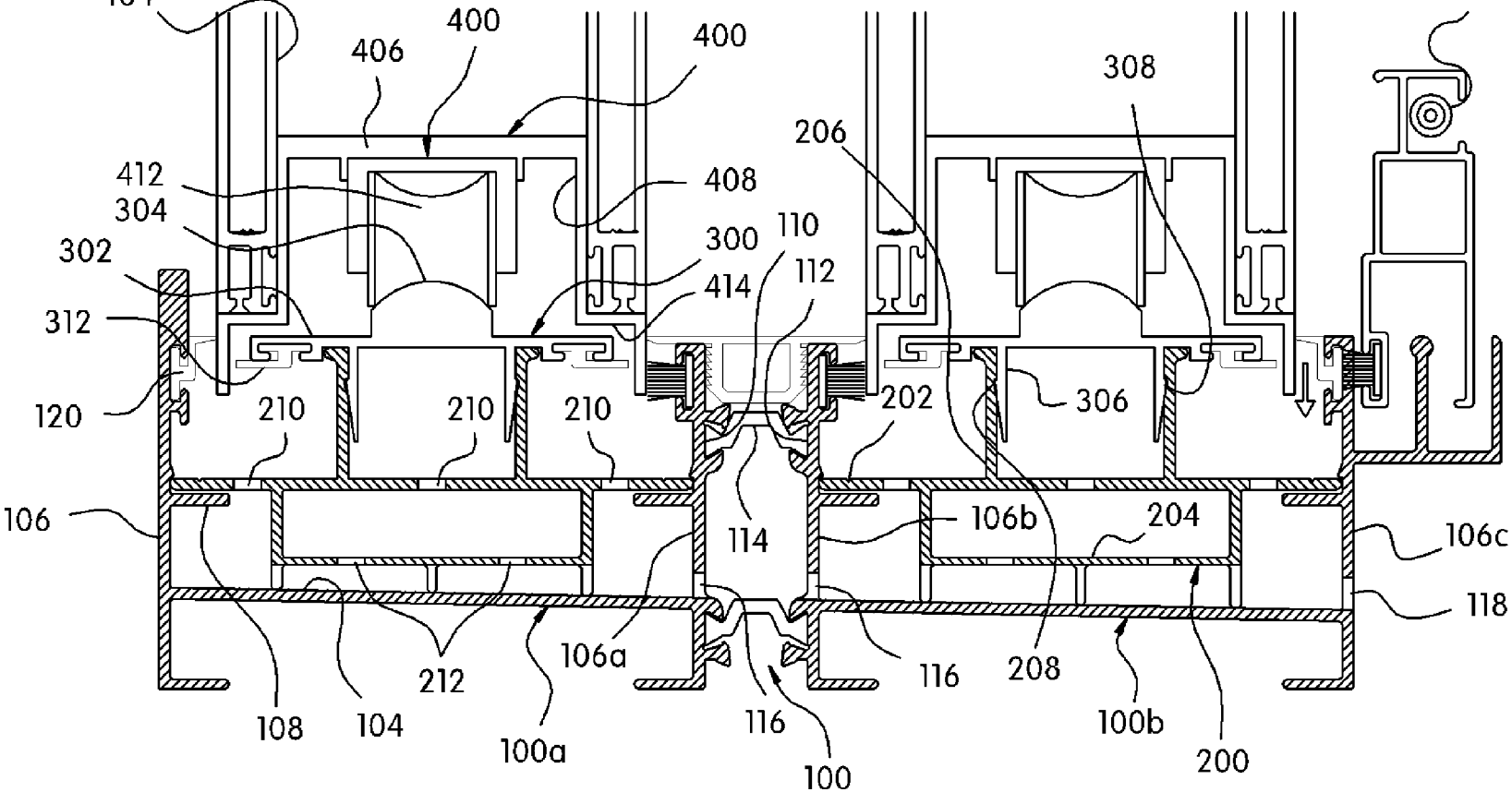
FIG. 6 is a sectional view illustrating another embodiment in relation to a roller and rail configuration of the easy-to-construct window apparatus in accordance with the present invention.

Although the rollers 412, which are attached to the lower surface of the top plate 406 of the press-fit structure 410 of the window drive unit 400 in a rolling movable manner, may be two or more small rollers as described above, the rollers may be replaced with a single large roller (see FIG. 6) if necessary. Accordingly, the rails 304 provided on the horizontal plate 302 of the rail unit 300 may include two rails to correspond to the two or more small rollers, or may include a single rail to correspond to the single large roller (see FIG. 6).

A first gasket 120 is attached to an upper end of the inner surface of each vertical plate 106 of the window frame fixing unit 100, and a second gasket 312 is attached to either lateral end of the lower surface of the horizontal plate 302 of the rail unit 300. As the first and second gaskets 120 and 312 are closely attached to an outer surface and an inner surface of each pedestal plate 414 of the window drive unit 400, the first and second gaskets 120 and 312 function to intercept, e.g., noise from the outside.

Figure 9:
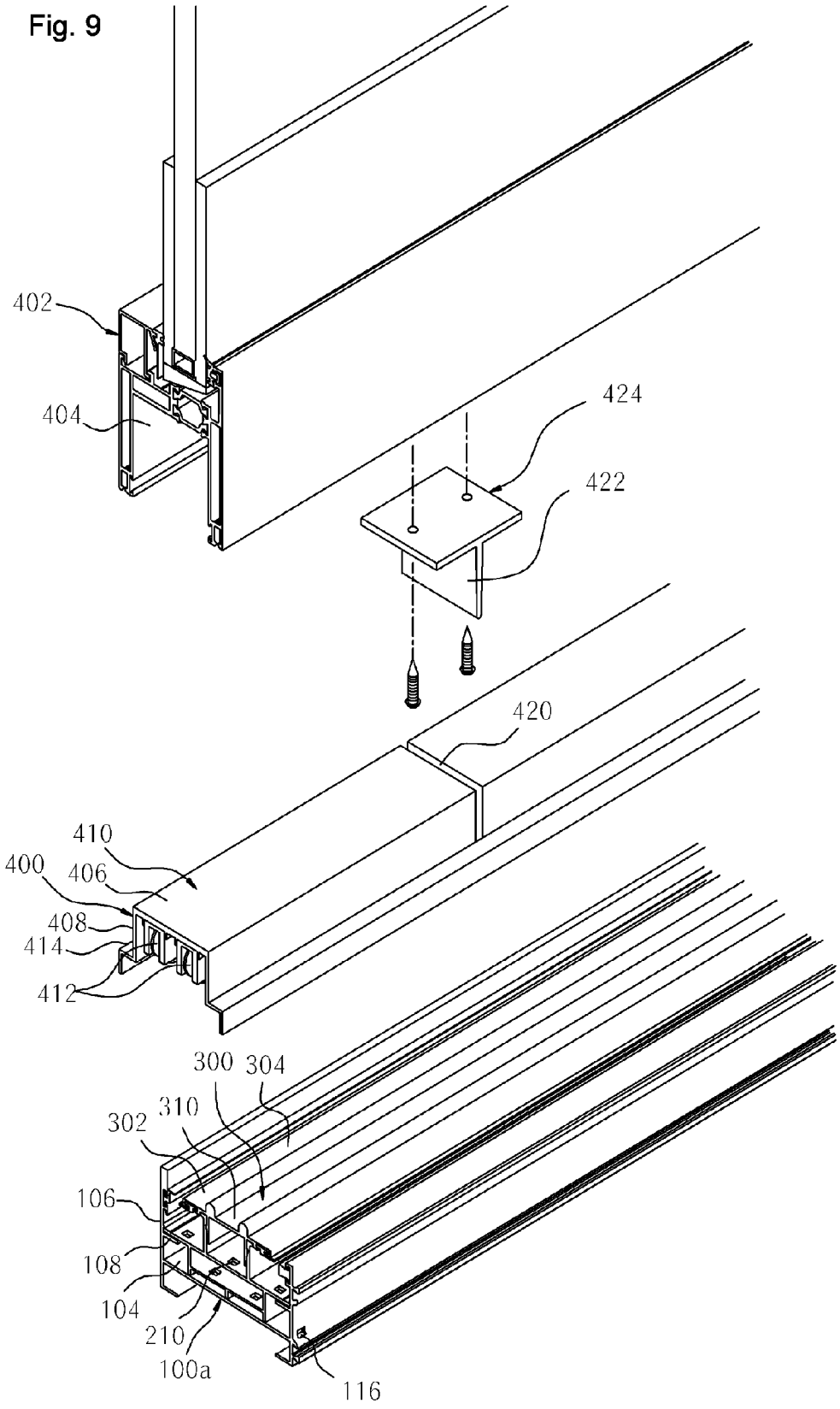
FIG. 9 is a perspective view illustrating another embodiment in relation to a connection configuration between a window and a window drive unit of the easy-to-construct window apparatus in accordance with the present invention.
Figure 10:
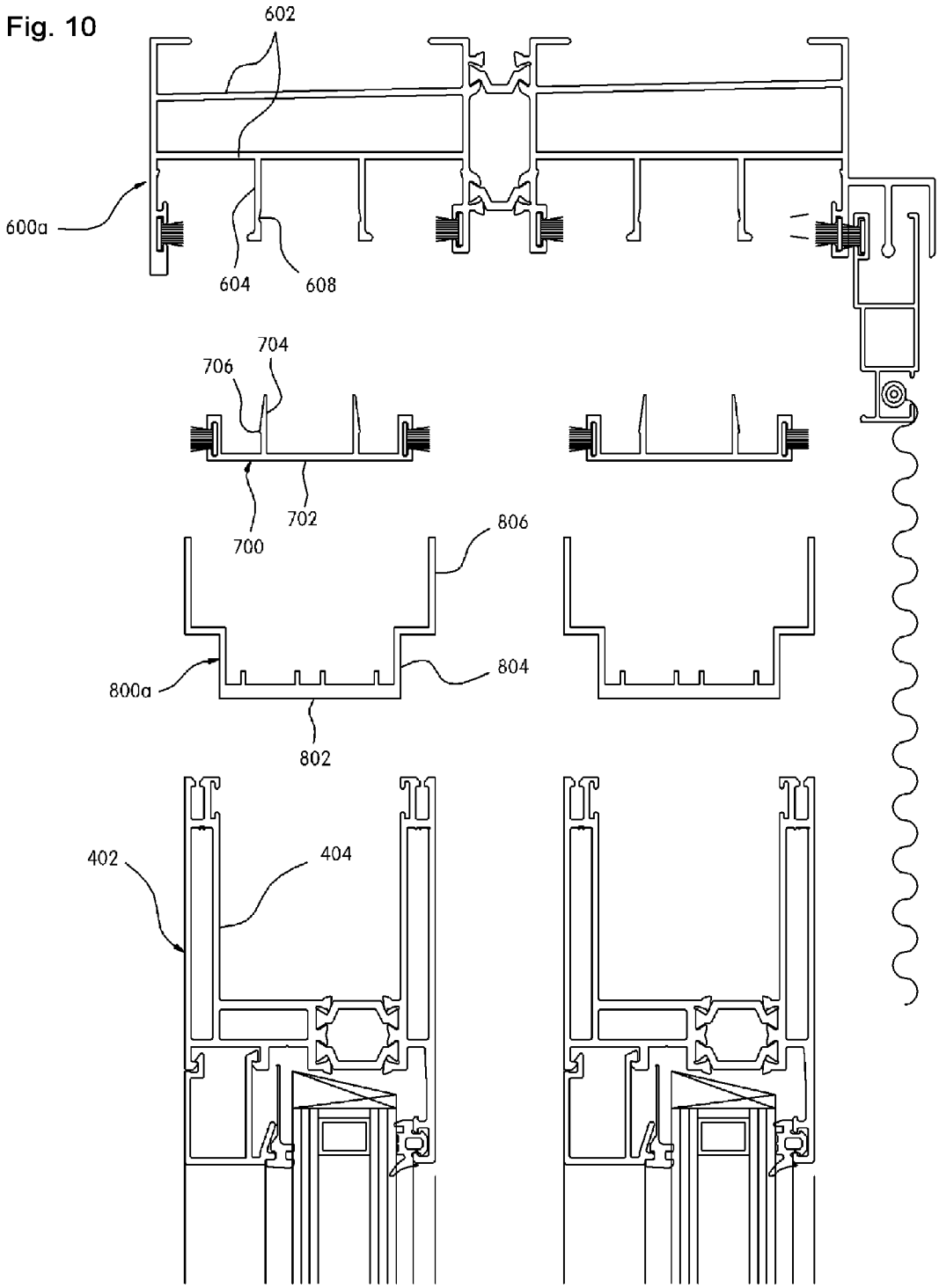
FIG. 10 is an exploded sectional view illustrating an upper window frame fixing unit of the easy-to-construct window apparatus in accordance with the present invention.
Figure 11:
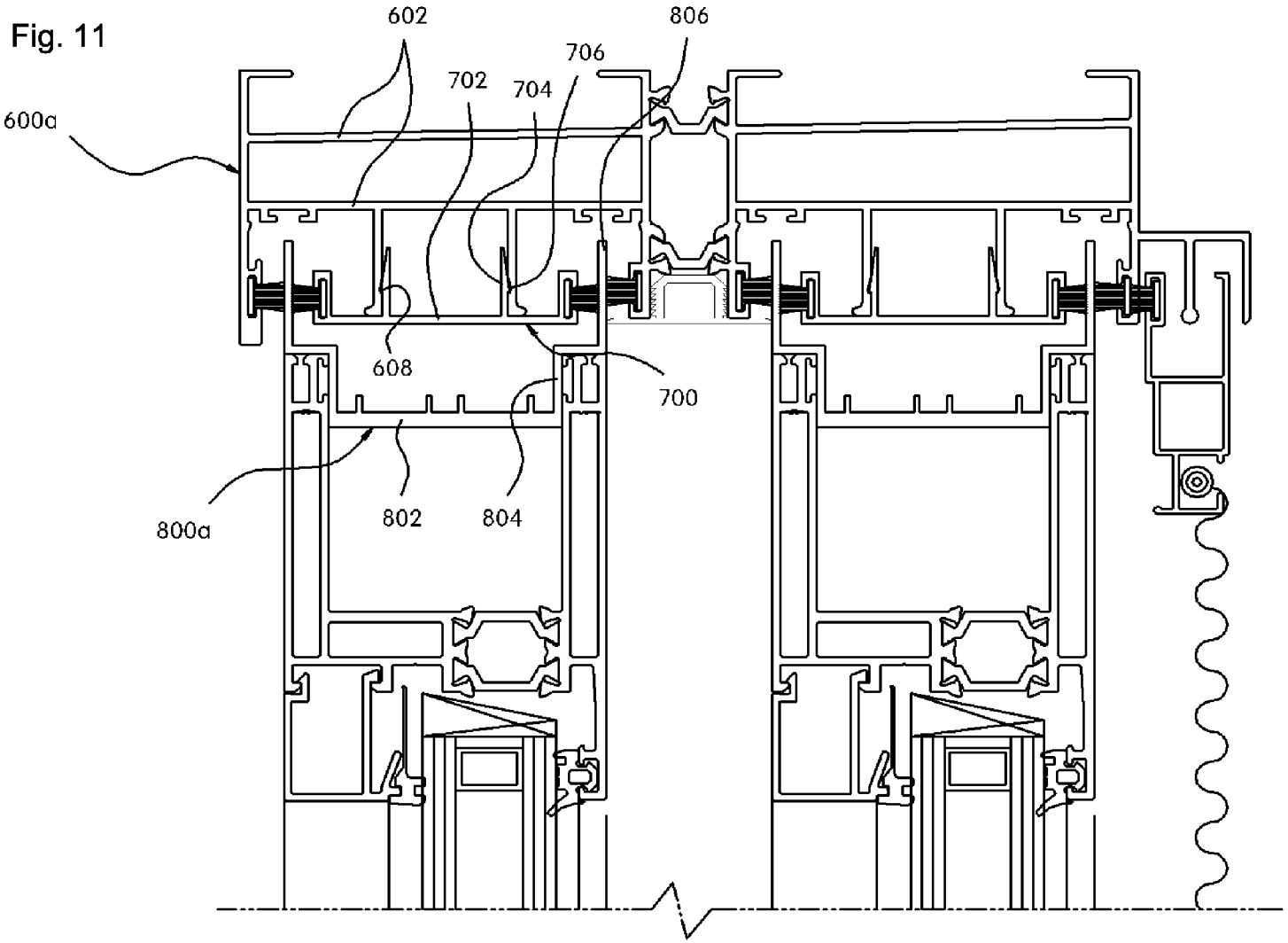
FIG. 11 is an assembled sectional view of FIG. 10.
Figure 12:
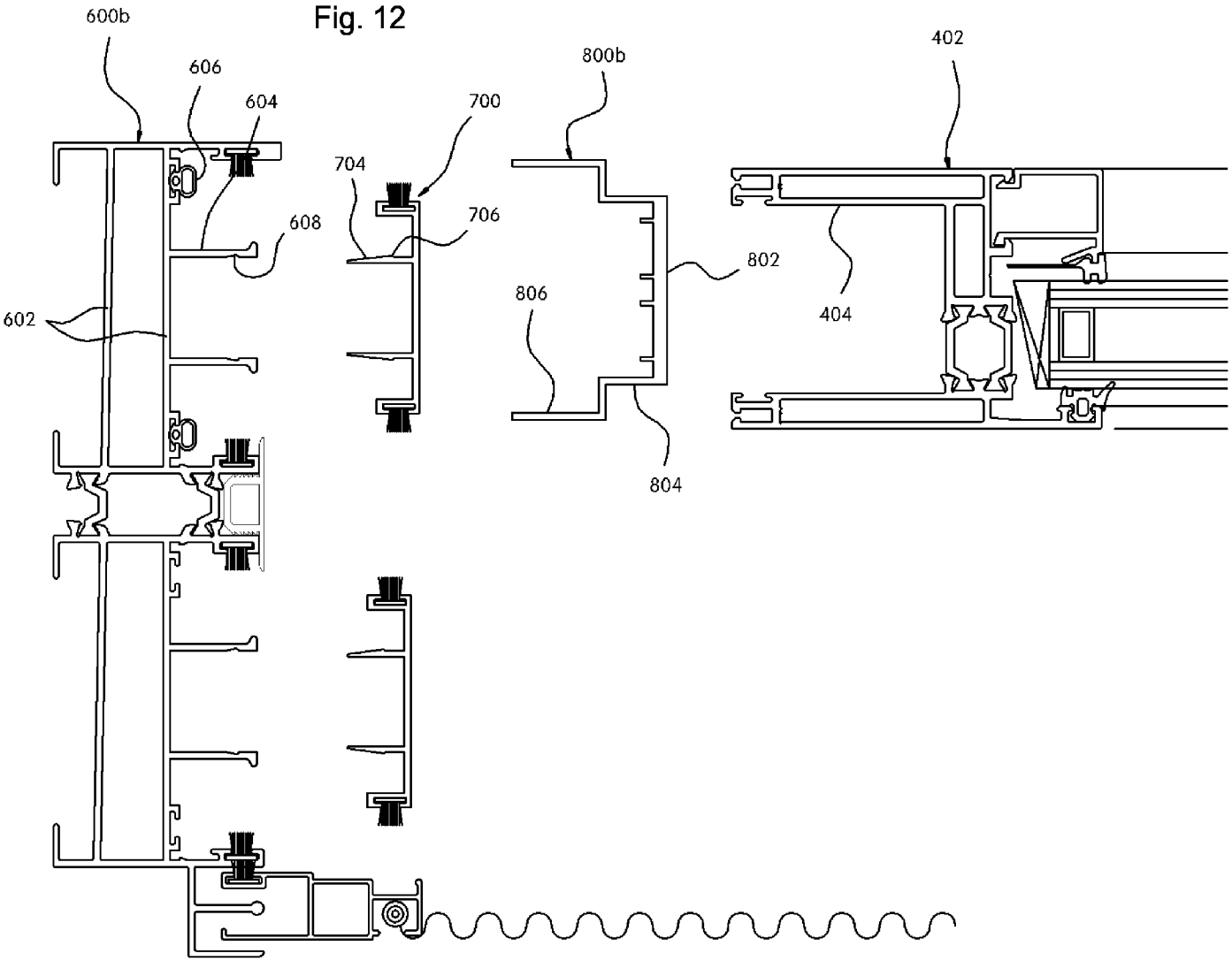
FIG. 12 is a sectional view illustrating a lateral window frame fixing unit of the easy-to-construct window apparatus in accordance with the present invention.
Figure 13:
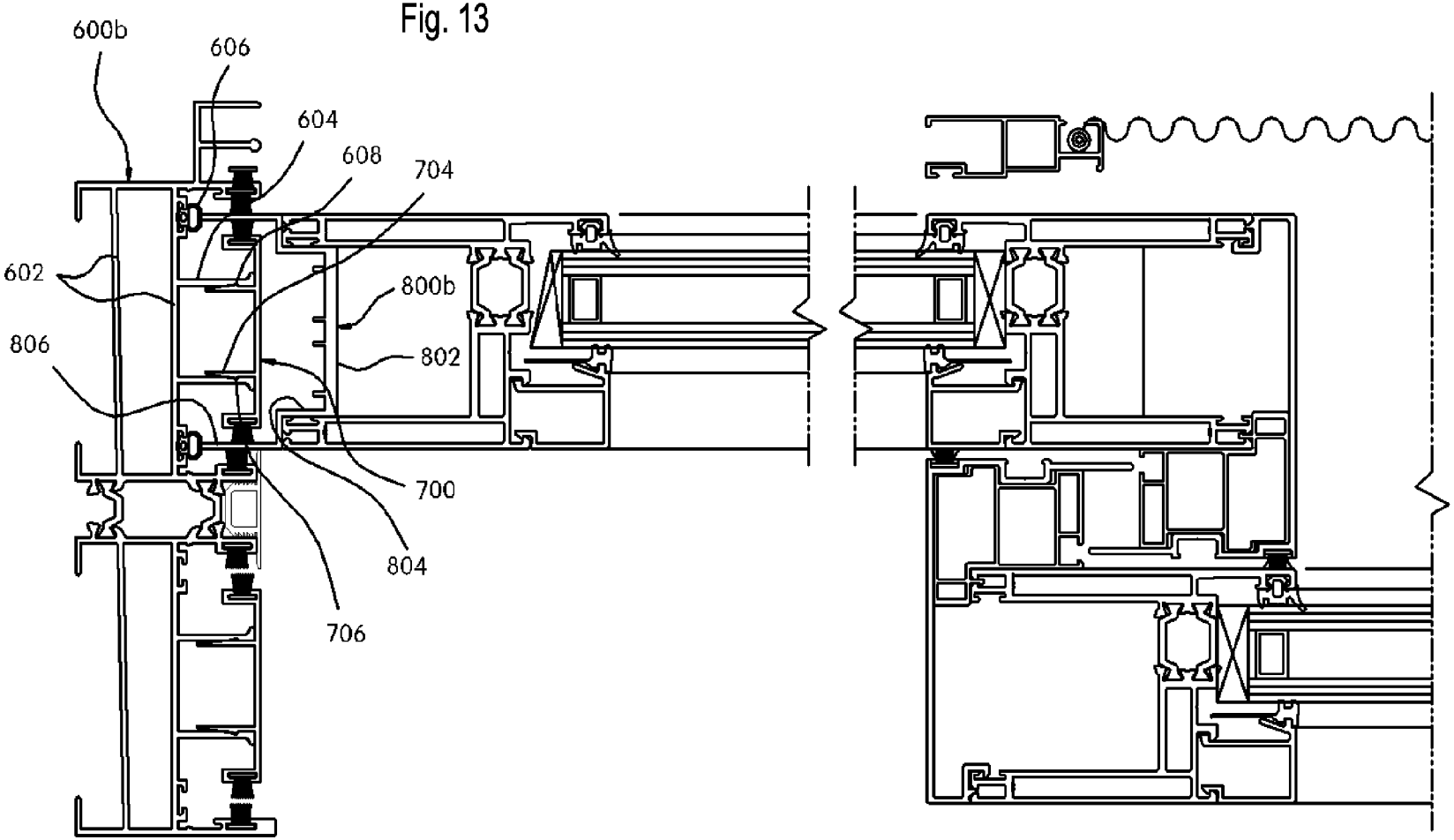
FIG. 13 is an assembled sectional view of FIG. 12.

In particular, referring to FIG. 9, the press-fit structure 410 of the window drive unit 400 is provided at an upper surface thereof with several fitting slots 420. The fitting slots 420 are vertically incised and are spaced apart from each other in a longitudinal direction of the press-fit structure 410. A fixing bracket 424 is integrally screwed to a ceiling surface of the press-fit room 404 of the window 402 and is provided with a downwardly protruding insert 422 so as to be inserted into a corresponding one of the fitting slots 420. With this configuration, during linear movement of the window 402 and the window drive unit 400, force applied to the window 402 is easily transmitted to the fitting slot 420 of the press-fit structure 410 of the window drive unit 400 through the insert 422, which can ensure linear movability of the window drive unit 400 when the window 402 is opened or closed.

In the above described assembled state, the window drive unit 400 can be lifted along with the window 402, which ensures easy removal of the window 402. Then, the coupling pieces 306 of the rail unit 300 can be easily separated in a one touch manner from the fastening pieces 206 of the window frame support unit 200 and subsequently, the window frame support unit 200 is lifted and separated from the window frame fixing unit 100. In conclusion, removal as well as assembly between the window frame fixing unit 100, the window frame support unit 200, the rail unit 300 and the window drive unit 400 can be easily accomplished, which ensures more efficient replacement and repair of the respective components. Moreover, owing to such easy removal thereof, it is possible to easily remove dust, etc. even from hard to access regions of the window frame fixing unit 100, the window frame support unit 200, the rail unit 300 and the window drive unit 400, which ensures an easy cleaning operation and assists in keeping these components clean.

Hereinafter, the configuration of water discharge holes provided in the window apparatus in accordance with the present invention will be described.

Figure 5:
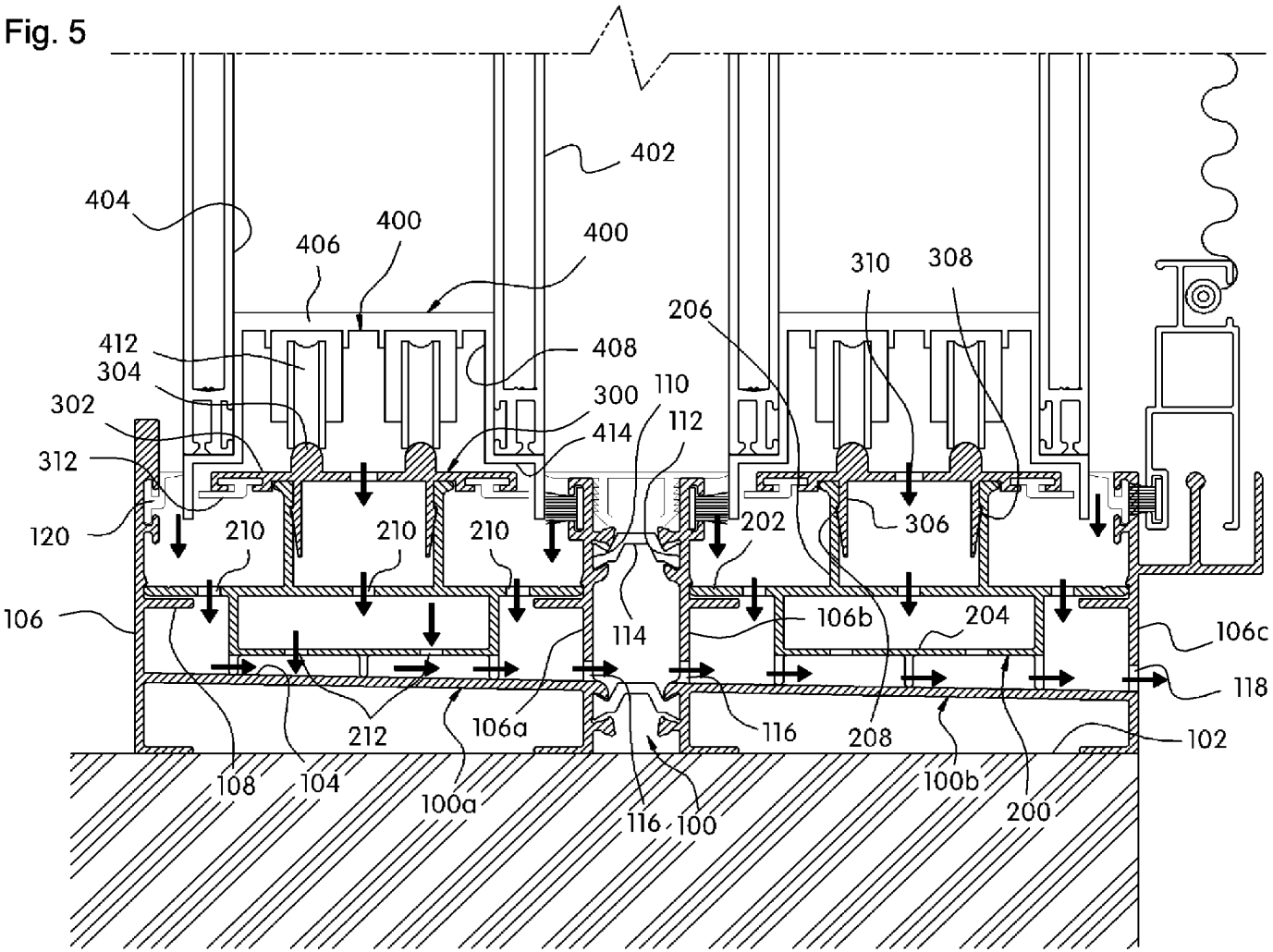
FIG. 5 is a sectional view explaining a water discharge mode of the easy-to-construct window apparatus in accordance with the present invention.
Figure 7:
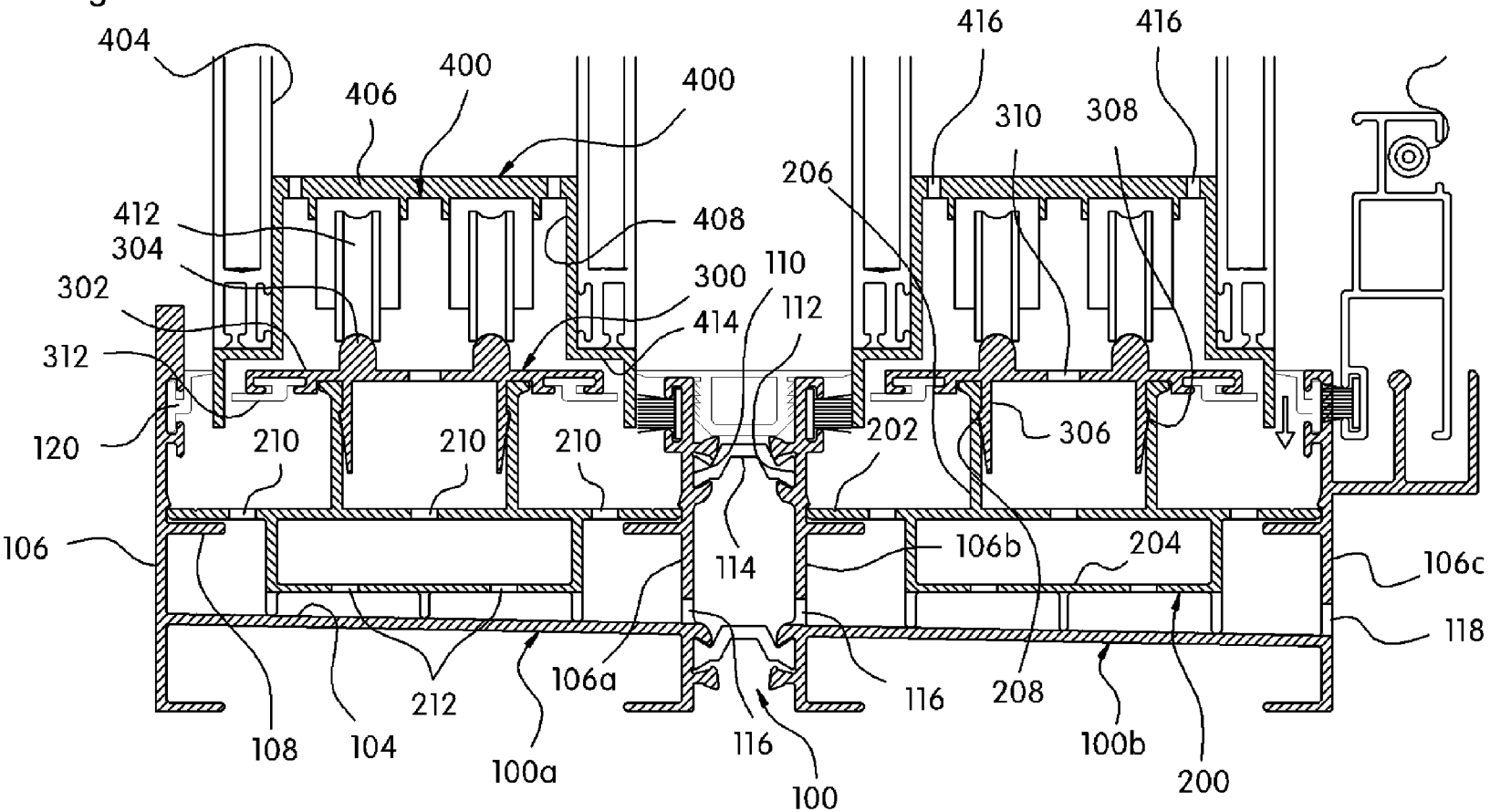
FIG. 7 is a sectional view illustrating another embodiment in relation to a water discharge configuration of the easy-to-construct window apparatus in accordance with the present invention.
Figure 8:
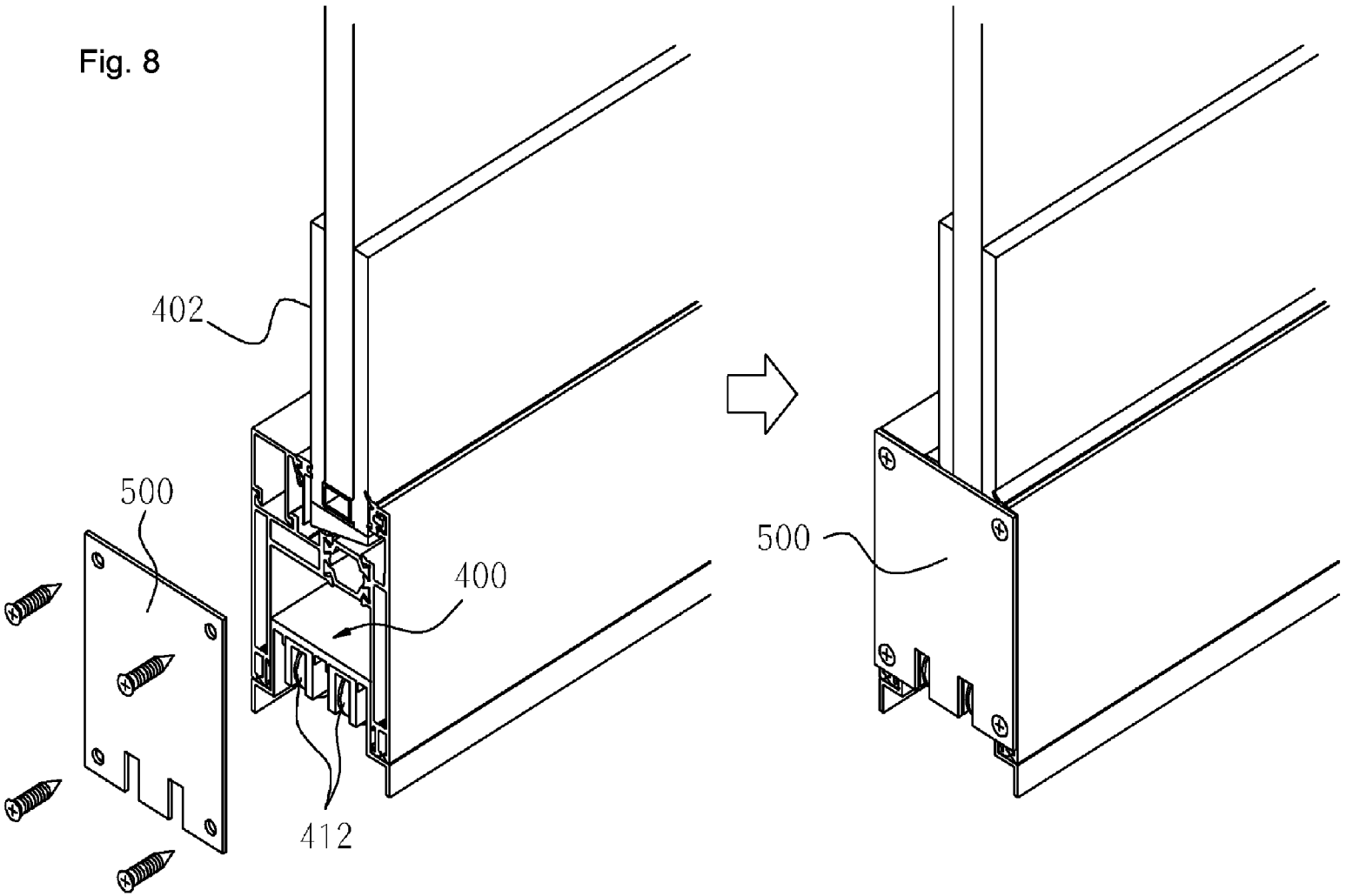
FIG. 8 is a perspective view illustrating attachment of a finishing plate to the easy-to-construct window apparatus in accordance with the present invention.

FIG. 5 is a sectional view explaining a water discharge mode of the easy-to-construct window apparatus in accordance with the present invention, and FIG. 7 is a sectional view illustrating another embodiment in relation to a water discharge configuration of the easy-to-construct window apparatus in accordance with the present invention.

The water discharge holes used in the present invention can be adapted not only to naturally discharge introduced rainwater to the outside, but also to naturally discharge even spilled beverages to the outside. In particular, the water discharge holes are intended to lead continuous natural discharge flow of water from the respective components.

The aforementioned components, i.e. the window frame fixing unit 100, the window frame support unit 200, the rail unit 300 and the window drive unit 400 are provided with a plurality of water discharge holes such that the water discharge holes can communicate with the outside.

Explaining the plurality of water discharge holes in a discharge flow order, a first water discharge hole 310 is vertically perforated through the horizontal plate 302 of the rail unit 300, a plurality of second water discharge holes 210 is vertically perforated through the seat plate 202 of the window frame support unit 200, a plurality of third water discharge holes 212 is vertically perforated through the support plate 204 of the window frame support unit 200, and the window frame fixing unit 100 is horizontally perforated with a fourth water discharge hole 116 and a final drain hole 118.

More particularly, the outer vertical plate 106*a* of the inner window frame fixing unit 100*a* and the inner vertical plate 106*b* of the outer window frame fixing unit 100*b* are horizontally perforated at lower end positions thereof with the fourth water discharge holes 116 respectively. The final discharge hole 118 is horizontally perforated at a lower end position of an outer vertical plate 106*c* of the outer window frame fixing unit 100*b* so as to communicate with the outside.

Preferably, as illustrated in FIG. 7, an auxiliary water discharge hole 416 may be vertically perforated through the top plate 406 of the press-fit structure 410 of the window drive unit 400, so as to discharge, e.g., moisture generated in the press-fit room 404 of the window 402.

Accordingly, as rainwater, spilled beverages, cleaning water or the like passes through the first water discharge hole 310 of the rail unit 300, the second water discharge holes 210 of the window frame support unit 200, the third water discharge holes 212 of the window frame support unit 200 and the fourth water discharge hole 116 of the window frame fixing unit 100 as represented by the arrows of FIG. 5, the water can be easily discharged to the outside through the final drain hole 118 while being naturally dried.

In the above described assembled configuration of the window apparatus in accordance with the present invention, a finishing plate 500 having a rectangular cross section is screwed to an opening of the window drive unit 400 press-fitted in the window 402 (i.e. either longitudinal end of the window drive unit 400). The finishing plate 500 is shaped to cover the longitudinal end of the window drive unit 400 except for the rollers 412.

Although the window frame fixing unit has been described above as being constructed on the floor, hereinafter, another preferred embodiment of the present invention in which the window frame fixing unit is arranged on the top or lateral side of the window apparatus will be described.

In relation to the window frame fixing unit 100 of the present invention constructed on the floor as described above, a pair of lateral window frame fixing units 600*b* is integrally connected to both ends of the window frame fixing unit 100 and an upper window frame fixing unit 600*a* is integrally connected to an upper end of each lateral window frame fixing unit 600*b*.

Although the upper and lateral window frame fixing units 600*a* and 600*b* have a configuration similar to the above described window frame fixing unit 100 constructed on the floor, the upper or lateral window frame fixing unit 600*a* or 600*b* includes a double layered bottom plate 602 and a pair of fastening pieces 604 integrally formed at the center of an upper surface of the double layered bottom plate 602, each fastening piece 604 having a holding groove 608. In particular, the lateral window frame fixing unit 600*b* is provided with a shock-absorbing stopper 606, which is situated outside each fastening piece 604 and is integrally attached to the upper surface of the bottom plate 602.

A finishing plate 700 is mounted to both the upper and lateral window frame fixing units 600*a* and 600*b*. The finishing plate 700 includes a flat plate 702 which has a plane when viewed from the outside, and a pair of coupling pieces 704 which is integrally formed at a lower surface of the flat plate 702 and each has a holding ridge 706 configured to be coupled with the holding groove 608 of the corresponding fastening piece 604 in a one touch manner.

Upper and lateral window finishing structures 800*a* and 800*b* are press-fitted into press-fit rooms 404 defined respectively in upper and lateral regions of the window 402. Each of the upper and lateral window finishing structures 800*a* and 800*b* includes a top plate 802, a lateral plate 804 and an L-shaped pedestal plate 806 at a lower end of the lateral plate 804, the top, lateral and leg plates being integrated with each other.

With the above described configuration, when viewing the upper and lateral window frame fixing units 600*a* and 600*b* upon opening or closing of the window 402, only the plane of the finishing plate 700 is exposed to the outside without exposure of the rails as in the prior art, which can provide an enhanced external appearance. Moreover, when the window 402 is closed, the pedestal plates 806 of the lateral window finishing structure 800*b* come into contact with the shock-absorbing stoppers 606, realizing shock-absorbing effects.

As described above, the easy-to-construct window apparatus in accordance with the present invention can ensure not only easy attachment or detachment of a window to or from a window frame, but also easy removal of the respective components, which results in ease in cleaning and assists in keeping the respective components clean. In addition, the window apparatus is free from invasion of impurities as well as wind or noise owing to a wind and noise shield configuration thereof, and can achieve a remarkable improvement in drainage ability by facilitating natural and easy discharge of rainwater or spilled beverages therefrom.

MODE FOR INVENTION

Various embodiments have been described in the best mode for carrying out the invention.

INDUSTRIAL APPLICABILITY

As is apparent from the above description, the present invention provides a window apparatus including a window, such as a balcony window or an entrance/exit door, and a window frame to which the window is coupled in a sliding opening/closing manner, wherein the window and the window frame are configured to be easy-to-construct and achieve superior drainage ability.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A window apparatus comprising:

at least one window frame fixing unit, which is fixedly mounted on a window frame installation plane in two or more rows, wherein the window frame fixing unit includes a bottom plate, vertical plates integrally formed at opposite lateral ends of the bottom plate, and a rack plate integrally formed at a middle height position of an inner surface of each vertical plate;

a window frame support unit including a seat plate, either lateral end of which is seated on the rack plate of the window frame fixing unit, a support plate integrally protruding downward from a lower surface of the seat plate so as to be supported on the bottom plate of the window frame fixing unit, a pair of fastening pieces integrally protruding upward from an upper surface of the seat plate, and a holding groove formed in an inner wall surface of each fastening piece;

a rail unit including a horizontal plate, a rail integrally protruding upward from an upper surface of the horizontal plate, a coupling piece protruding downward from a lower surface of the horizontal plate, and a holding ridge integrally formed at an outer wall surface of the coupling piece so as to be coupled with the holding groove;

a window drive unit including a press-fit structure configured to be press-fitted into a press-fit room defined in a lower region of a window, the press-fit structure including a top plate and lateral plates integrated with each other, a roller coupled to a lower surface of the top plate of the press-fit structure in a rolling movable manner, and an L-shaped pedestal plate provided at each lower end of each lateral plate of the press-fit structure so as to support the window while being inserted into a space between the vertical plate of the window frame fixing unit and the horizontal plate of the rail unit; and a plurality of water discharge holes perforated in the window frame fixing unit, the window frame support unit, the rail unit and the window drive unit so as to communicate with outside the window apparatus.

2. The apparatus according to claim 1, wherein the at least one window frame fixing unit, which is mounted on the window frame installation plane in two or more rows, includes an inner window frame fixing unit and an outer window frame fixing unit, and wherein an outer vertical plate of the inner window frame fixing unit and an inner vertical plate of the outer window frame fixing unit are respectively provided with first and second coupling grooves, and a connection strip having a hermetic function is inserted into the first and second coupling grooves, so as to provide a hermetic coupling between the inner window frame fixing unit and the outer window frame fixing unit.

3. The apparatus according to claim 1, wherein the plurality of water discharge holes includes:

a first water discharge hole vertically perforated through the horizontal plate of the rail unit;

a plurality of second water discharge holes vertically perforated through the seat plate of the window frame support unit;

a plurality of third water discharge holes vertically perforated through the support plate of the window frame support unit;

a plurality of fourth water discharge holes horizontally perforated respectively at lower end positions of the outer vertical plate of the inner window frame fixing unit and the inner vertical plate of the outer window frame fixing unit; and a final drain hole horizontally perforated at a lower end position of an outer vertical plate of the outer window frame fixing unit.

4. The apparatus according to claim 1, wherein:

vertically incised fitting slots are longitudinally arranged at an upper surface of the press-fit structure of the window drive unit, and a fixing bracket is screwed to a ceiling surface of the press-fit room of the window and is provided with a downwardly protruding insert so as to be inserted into a corresponding one of the fitting slots.

5. The apparatus according to claim 1, further comprising:

upper and lateral window frame fixing units connected to the window frame fixing unit so as to be located at upper and lateral sides of the window frame fixing unit, the upper or lateral window frame fixing unit including a double layered bottom plate and a pair of fastening pieces formed at the center of an upper surface of the double layered bottom plate, each fastening piece having a holding groove;

a finishing plate including a flat plate, and a pair of coupling pieces formed at a lower surface of the flat plate, each coupling piece having a holding ridge configured to be coupled with the holding groove of a corresponding one of the pair of fastening pieces;

upper and lateral window finishing structures configured to be press-fitted into press-fit rooms defined respectively in upper and lateral regions of the window, each window finishing structure including a top plate, lateral plates and L-shaped pedestal plates at each lower end of each lateral plate; and a shock-absorbing stopper situated outside each fastening piece of the lateral window frame fixing unit and integrally attached to the upper surface of the bottom plate of the lateral window frame fixing unit.

* * * * *